US006666783B1

(12) United States Patent
Huang

(10) Patent No.: US 6,666,783 B1
(45) Date of Patent: Dec. 23, 2003

(54) BASEBALL (SOFTBALL) WITH DOUBLE ROW RIDGE STITCHING

(76) Inventor: Yao-Jen Huang, C/O PMB#1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 0 days.

(21) Appl. No.: 10/163,524

(22) Filed: Jun. 7, 2002

(51) Int. Cl.[7] ..... A63B 37/12
(52) U.S. Cl. ..... 473/598; 473/600
(58) Field of Search ..... 473/597, 610, 473/608, 598, 600, 601, 602; D21/707

(56) References Cited

U.S. PATENT DOCUMENTS 1,660,378 A * 2/1928 Dieterle ..... 473/597
1,668,969 A * 5/1928 Maynard ..... 473/598
1,988,722 A * 1/1935 De Beer ..... 473/598
2,840,024 A * 6/1958 Haas ..... 473/598

* cited by examiner

*Primary Examiner*—Steven Wong
(74) *Attorney, Agent, or Firm*—Leong C. Lei

(57) ABSTRACT

A baseball (softball) includes a core and a pair of surface layers which are configured to enclose the core, wherein each of the surface layers is formed with an outer row of holes and an inner row of holes, the holes being formed in alternate order, and a needle with a thread is passed through the holes to stitch the two surface layers together thereby causing the thread to pull a portion between the holes and a circumferential edge of the surface layers to curve inwardly thereby forming a ridge, whereby the baseball is easy to manufacture and low in cost.

1 Claim, 4 Drawing Sheets

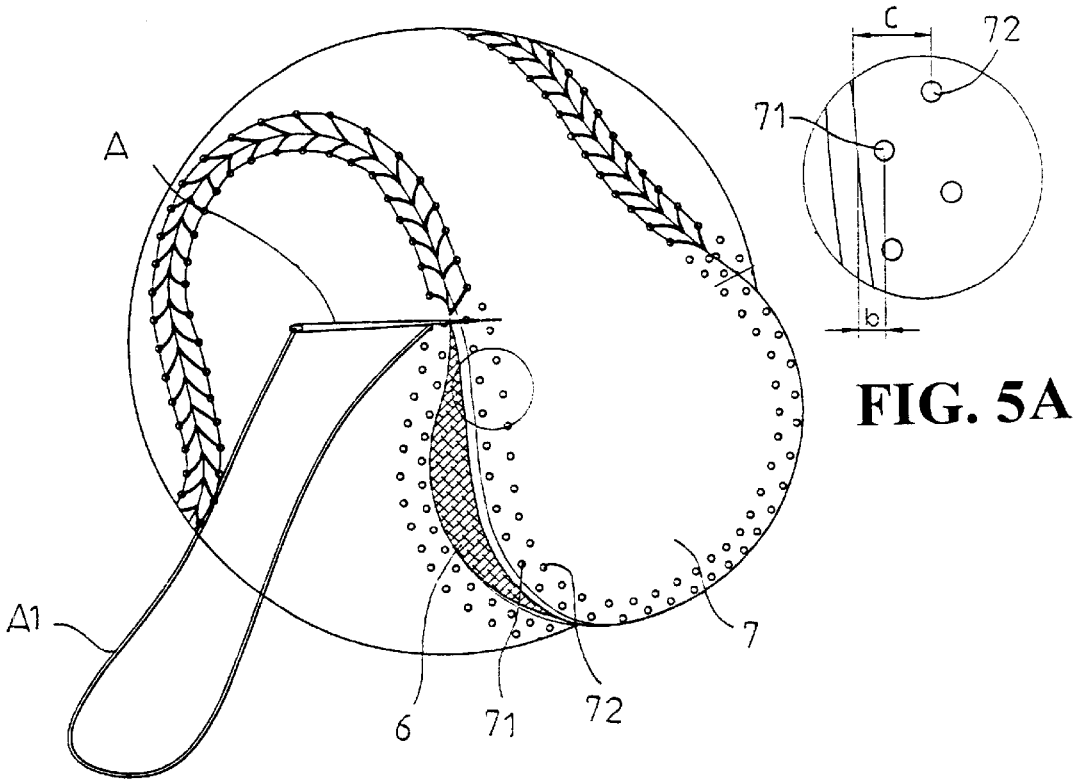
FIG. 5A
FIG. 5
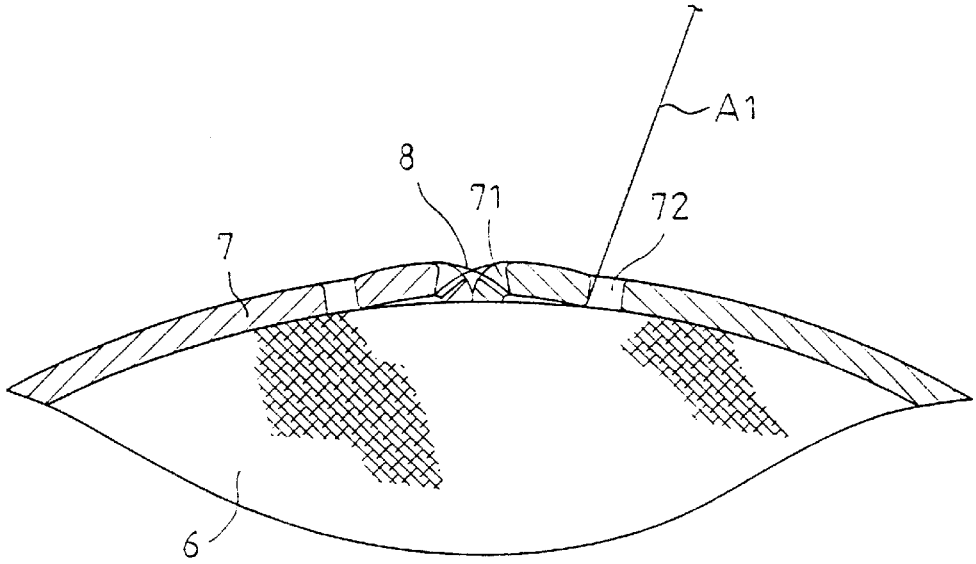
FIG. 6

BASEBALL (SOFTBALL) WITH DOUBLE ROW RIDGE STITCHING

BACKGROUND OF THE INVENTION

Field of the Invention

This invention is related to an improvement in the structure of a baseball (softball) and in particular to one with double row ridge stitching. Baseball and softball are popular games in the United States and elsewhere. The conventional baseball is shown in FIGS. 1 and 2. The conventional baseball comprises a core 1 on which are stitched two surface layers 2. The surface layer 2 is generally shaped like a bone, and has a plurality of equidistant holes 21. The two surface layers 2 are fitted to enclose the core, and stitched together. When stitching, a needle A with a thread A1 passes through the holes to stitch them together, so as to enclose the core completely, thereby forming a baseball. This structure has long been used by the manufacturer, but when the two surface layers 2 are stitched together, since the two surface layers 2 join together at the circumference, when the thread A1 passes through the holes 21 of the two surface layers 2, the thread A1 will pull the two surface layers 2 and the force of this tension will cause one of the surface layers to move on top of the other, thereby causing stress concentration at that portion. As a result, the surface layer will often come apart at the stitching. Furthermore, in stitching operation, the operator has to pass the thread A1 through the holes 21 while also holding the surface layer portion being stitched to prevent movement, thereby making the operation very slow and requiring very experienced operators, and therefore increasing the manufacturing cost and limiting production rate. Moreover, if the stitching is skillful, the surface layer will be very smooth. But the ball will easily slip out of the hands of a pitcher. Further, the smoothness of the ball can cause the ball to slip in the hands when throwing, therefore causing the direction of the throw to be altered. In addition, if the outer surface of the baseball is very smooth, the batter will easily hit the center of the ball, making the ball fly a longer distance. Hence, this kind of baseball is not good for the pitcher, but is beneficial to the batter.

Referring to FIGS. 3 and 4, another conventional baseball (softball) comprises a core 3, two surface layers 4 and a layer of compressed threading 5, wherein the surface layer 4 is formed with a plurality of equidistant holes 41 along this circumference. The layer of compressed threading 5 is positioned between the two surface layers 4 and the core 3. A thread is used to stitch the surface layers 4 and the cotton threading 5 into the core to form a slight ridged portion between the two surface layers 4, so as to make the pitcher hold the ball more securely. However, the compressed threading layer 5 is not fixed in shape and it is necessary to move the compressed threading layer 5 to the desired position while using the needle to pass through the holes of the surface layer 4, making the operation more time-consuming, and increasing production costs. In addition, it is difficult for the manufacturer to produce a compressed threading layer 5 with the same dimension, so that the height of the ridge will be different for different baseballs.

Therefore, it is an object of the present invention to provide an improvement in the structure of a baseball (softball) which can obviate and mitigate the above-mentioned drawbacks.

SUMMARY OF THE INVENTION

This invention is related to an improvement in the structure of a baseball (softball).

It is the primary object of the present invention to provide an improved baseball (softball) which enables a thrower to have better controllability of the ball, It is another object of the present invention to provide an improved baseball (softball) which can be easily manufactured.

It is a further object of the present invention to provide a baseball (softball) which includes a core and a pair of surface layers which are configured to enclose the core, wherein each of the surface layers is formed with an outer row of holes and an inner row of holes, the holes being formed in alternate order, and a needle with a thread is passed through the holes to stitch the two surface layers together thereby causing the thread to pull a portion between the holes and a circumferential edge of the surface layers to curve inwardly thereby forming a ridge.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 5 is a perspective view of an improved baseball (softball) according to the present invention;

FIG. 5A is an enlarged view of a portion of FIG. 5; and

FIG. 6 is an enlarged sectional view of a portion of the present invention.

DETAILED DESCRIPTION OF THE PREFERRED EMBODIMENT

Figure 1:
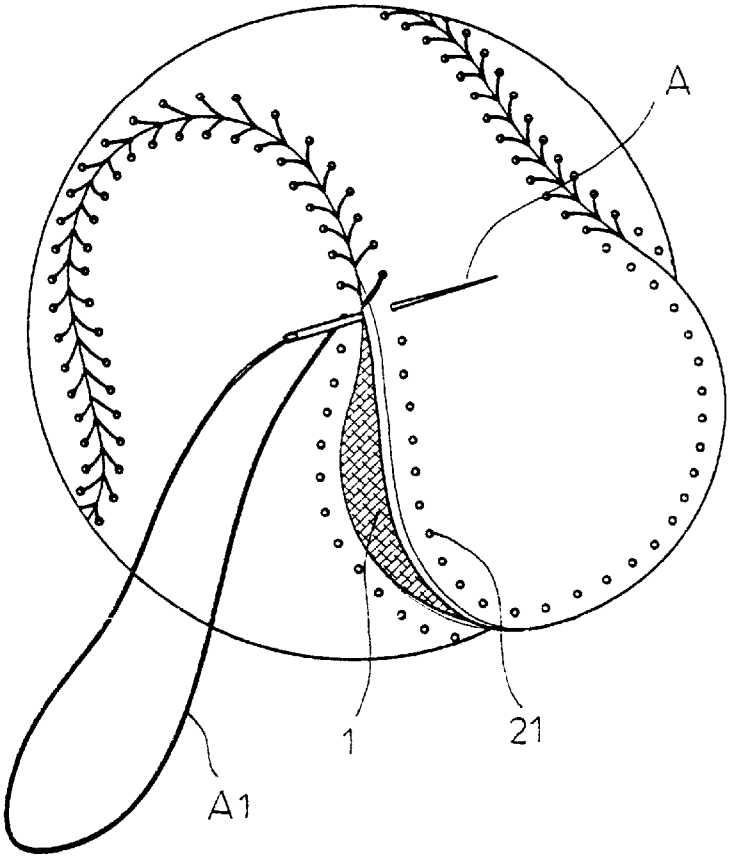
PRIOR ART FIG. 1
FIG. 1 illustrates a first conventional baseball.
Figure 2:
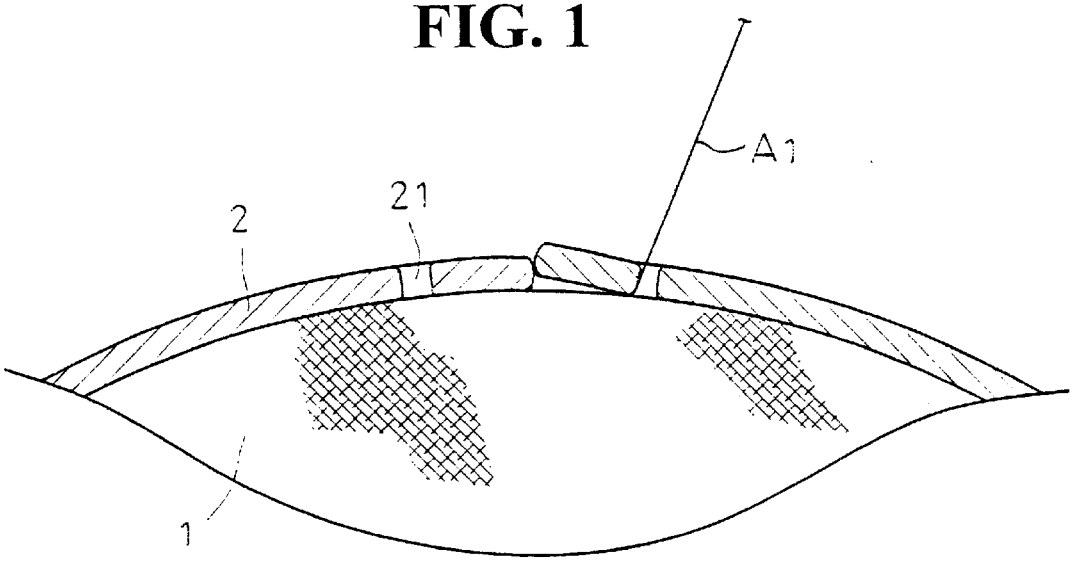
PRIOR ART FIG. 2
FIG. 2 is an enlarged sectional view of a portion of the first conventional baseball.
Figure 3:
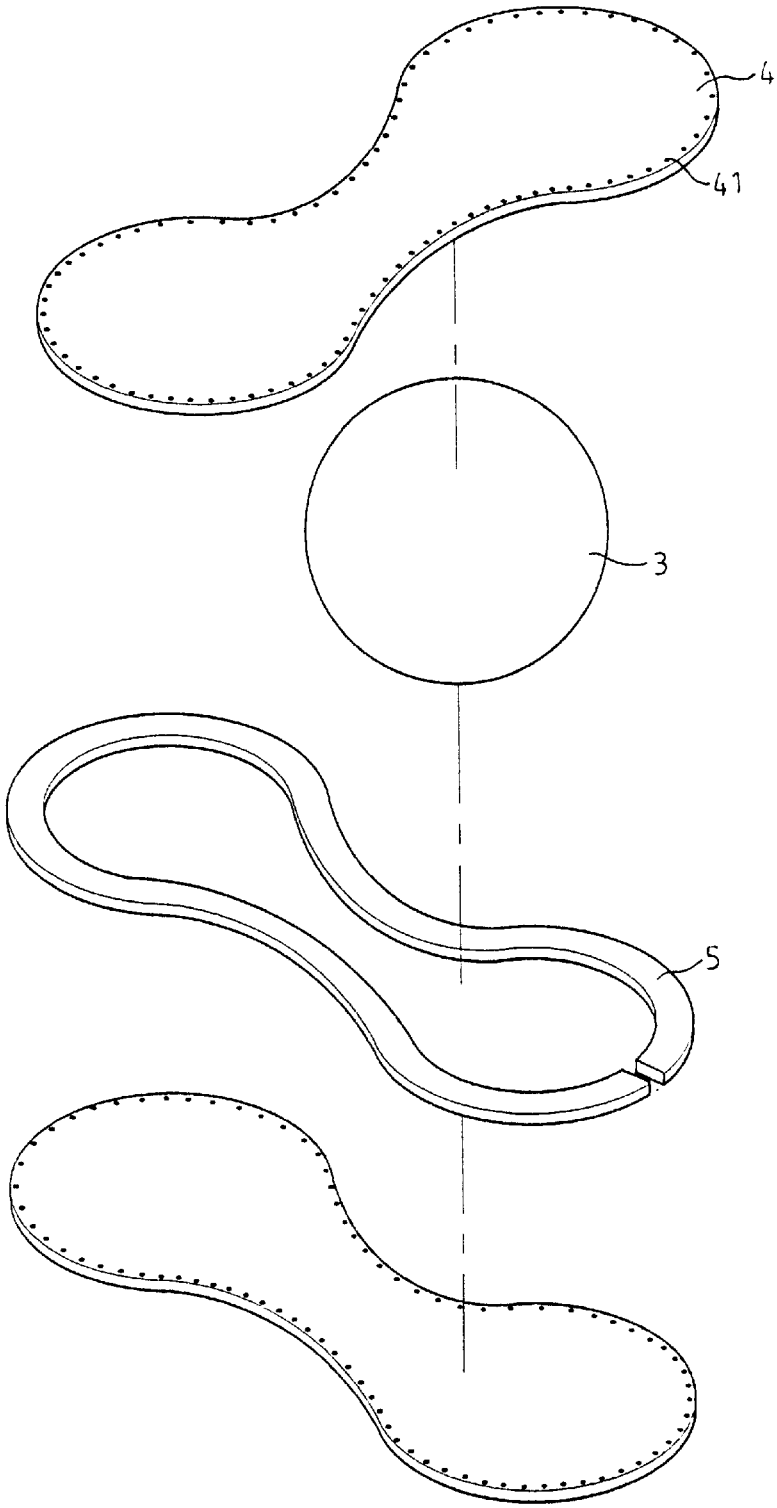
PRIOR ART FIG. 3
FIG. 3 illustrates a second conventional baseball.
Figure 4:
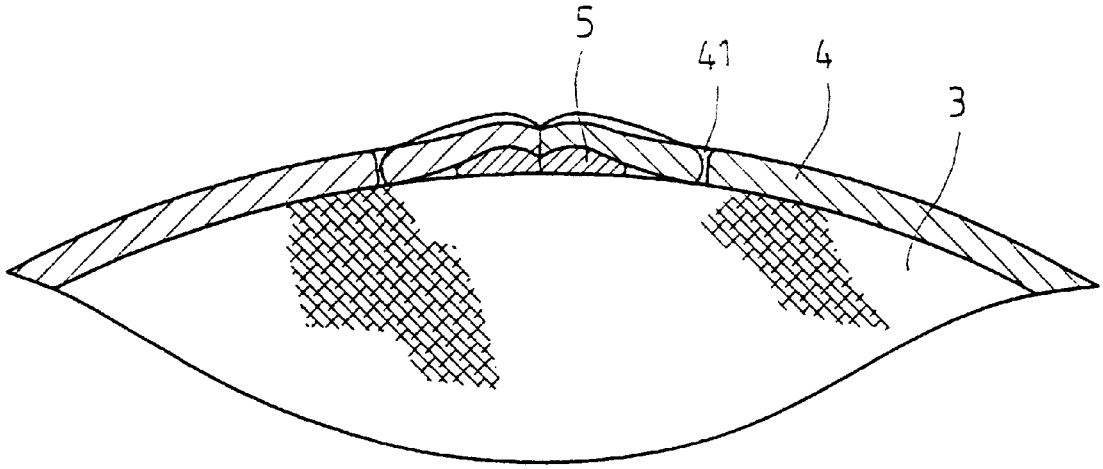
PRIOR ART FIG. 4
FIG. 4 is an enlarged sectional view of a portion of the second conventional baseball.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 5, 5A and 6, the baseball (softball) according to the present invention comprises a core 6, two bone-shaped outer layers 7; the present invention is characterized in that the surface layer 7 is formed with a first row of holes 71 and a second row of holes 72. The holes 72 and the holes 71 are side by side, but are punched in alternate order as shown in FIG. 5. The distance "b" between the hole 71 and the outer edge of the surface layer 7 is 1 to 5 mm, as shown in FIG. 5A, the preferred distance C between the hole 72 and circumference of the surface layer 7 is 5 to 15 mm. As a needle A with thread A1 is used for stitching the two surface layers 7 together, the thread A1 will pull the portion between the hole 71 and the circumferential edge of the surface layer 7 to curve inwardly, thereby forming a ridge 8. Since the holes are formed by a punching machine, the holes 71 and 72 of the surface layer 7 are formed on predetermined positions, and the distance between the holes 71 and the circumferential edge 7 is a fixed value, the height of the ridge 8 will be uniform.

By means of the design of the outer holes 71 and inner holes 72 of the surface layer 7, the two surface layers 7 will not buckle as a result of over-tight stitching. It is easier to use a needle A for stitching. Further, the circumferential edge of the surface layer 7 will be closely and tightly stitched on the core, and will not be easily broken, prolonging the surface life and the ridge 8 will enable the pitcher to hold the ball more securely, the flying direction will not be affected, a thrower will have better controllability of the ball, and if the bat hits the ridge 8, the ball will easily deflect it, making it difficult for the batter to hit the center of the ball.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A baseball (softball) comprising a core and a pair of surface layers which are configured to enclose said core, wherein each of said surface layers is formed with an outer row of holes and an inner row of holes, said holes being formed in alternate order, and a needle with a thread is passed through said holes to stitch said two surface layers together thereby causing said thread to pull a portion between said holes and a circumferential edge of said surface layers to curve inwardly thereby forming a ridge, and wherein a preferred distance between said outer holes to a circumferential edge of said surface layers is 1–5 mm, and a preferred distance between said inner holes to a circumferential edge of said surface layers is 5–15 mm.

* * * * *